US007762690B2

(12) United States Patent
Li et al.

(10) Patent No.: US 7,762,690 B2
(45) Date of Patent: Jul. 27, 2010

(54) LED LAMP HAVING AN IMPROVED WATERPROOFING STRUCTURE

(75) Inventors: Hao Li, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 256 days.

(21) Appl. No.: 12/105,291

(22) Filed: Apr. 18, 2008

(65) Prior Publication Data

US 2009/0262542 A1 Oct. 22, 2009

(51) Int. Cl.
*F21V 29/00* (2006.01)

(52) U.S. Cl. ..... 362/294; 362/345; 362/267

(58) Field of Classification Search ..... 362/294, 362/373, 345, 264, 218, 126, 547, 580, 800, 362/267, 158
See application file for complete search history.

(56) References Cited

U.S. PATENT DOCUMENTS

| | | | | |
|---|---|---|---|---|
| 7,588,355 | B1 * | 9/2009 | Liu et al. | 362/373 |
| 7,637,637 | B2 * | 12/2009 | Liu et al. | 362/294 |
| 2009/0168416 | A1 * | 7/2009 | Zhang et al. | 362/234 |

* cited by examiner

*Primary Examiner*—Bao Q Truong
(74) *Attorney, Agent, or Firm*—Frank R. Niranjan

(57) ABSTRACT

An LED lamp includes a heat sink, and a plurality of LED modules attached to the heat sink. The heat sink includes a base and a plurality of fins extending from the base. The LED modules each include a substrate plate thermally attached to the base of the heat sink and a plurality of LEDs mounted on the substrate plate. A housing includes a frame surrounding the base of the heat sink, and cooperates with the heat sink to define a first cavity between the frame and the base of the heat sink. A first waterproof gasket is received in the first cavity and surrounds the base of the heat sink. A hood covers over the LEDs of the LED modules and contacts the frame of the housing. A second cavity is defined among the hood, the frame of the housing and the body. A second waterproof gasket is received in the second cavity.

18 Claims, 4 Drawing Sheets

LED LAMP HAVING AN IMPROVED WATERPROOFING STRUCTURE

BACKGROUND OF THE INVENTION

1. Field of the Invention

The present invention relates to an LED lamp, more particularly to an improved waterproofing structure of an LED lamp.

2. Description of Related Art

LEDs (Light Emitting Diodes) are well known solid state light sources. An LED is a member for transferring electricity to light by using a theory that, if a current is made to flow in a forward direction in a junction comprising two different semiconductors, electrons and cavities are coupled at the junction region to generate a light beam. The LED has an advantage that it is resistant to shock, and has an almost eternal lifetime under a specific condition; thus, when the LED is used in a lamp, it is intended to be a cost-effective yet high quality replacement for incandescent and fluorescent lamps.

An LED lamp generally requires a plurality of LEDs, and most of the LEDs are driven at the same time, which results in a quick rise in temperature of the lamp. Generally, since the lamps do not have heat dissipation devices with good heat dissipating efficiencies, operation of the lamps has a problem of instability because of the rapid increase of heat. Consequently, the LED lamp usually comprises a heat sink contacting the LEDs to dissipate the heat generated by the LEDs.

When the LED lamp is used outdoors, the LED lamp needs to be constructed with a waterproof structure to protect the LEDs in the lamp from damage of rain or snow or other weather conditions. Generally, the waterproof structure includes a waterproof gasket with a round cross section and a groove defined in a housing which accommodates the LEDs therein. The LED lamp has a hood covering the housing and pressing the waterproof in the groove. By this, the waterproof structure can protect the LEDs from water. However, this structure needs the housing to have a portion defining the special groove therein to accommodate the waterproof gasket, which complicates the structure and increases the volume of the housing. Accordingly, the volume of the LED lamp is also increased. In addition, the formation of the groove in the housing complicates the mould for forming the housing, whereby the mould has a high cost.

What is needed therefore is an LED lamp having a simple structure and better waterproof capacity.

SUMMARY OF THE INVENTION

An LED lamp in accordance with a preferred embodiment of the present invention comprises a heat sink, and a plurality of LED modules attached to the heat sink. The heat sink comprises a base and a plurality of fins extending from the base. The LED modules each comprise a substrate plate thermally attached to the base of the heat sink and a plurality of LEDs mounted on the substrate plat. A housing comprises a frame surrounding the base of the heat sink, and cooperate s with the heat sink to define a first cavity between the frame and the base of the heat sink. A first waterproof gasket is received in the first cavity and surrounds the base of the heat sink. A hood covers over the LEDs of the LED modules and contacts the frame of the housing. A second cavity is defined among an annular body of the hood, the frame of the housing and the base of the heat sink. A second waterproof gasket is received in the second cavity and surrounds the base of the heat sink. The first waterproof gasket forms a hermetical connection between a lower portion of the frame of the housing and a lower portion of the base of the heat sink. The second waterproof gasket forms a hermetical connection among an upper portion of the frame of the housing, an upper portion of the base of the heat sink and a bottom face of the body of the hood. Thus, the LED module can be hermetically received in the LED lamp.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
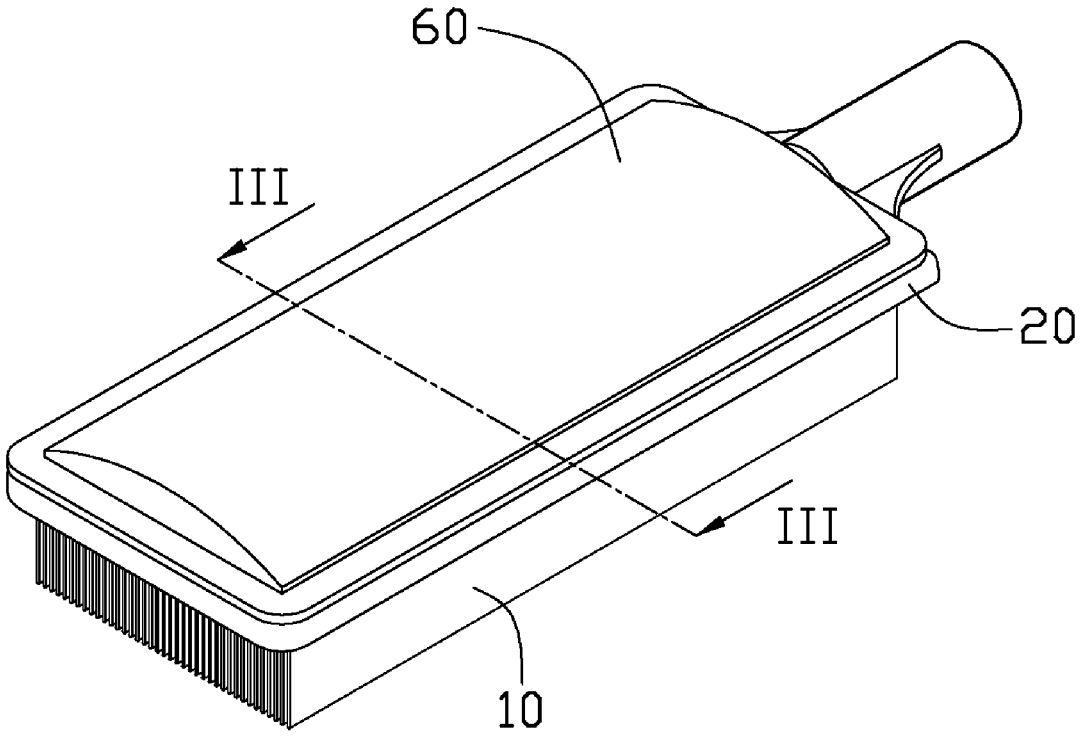
FIG. 1 is an isometric, assembled view of an LED lamp in accordance with a preferred embodiment of the present invention.
Figure 2:
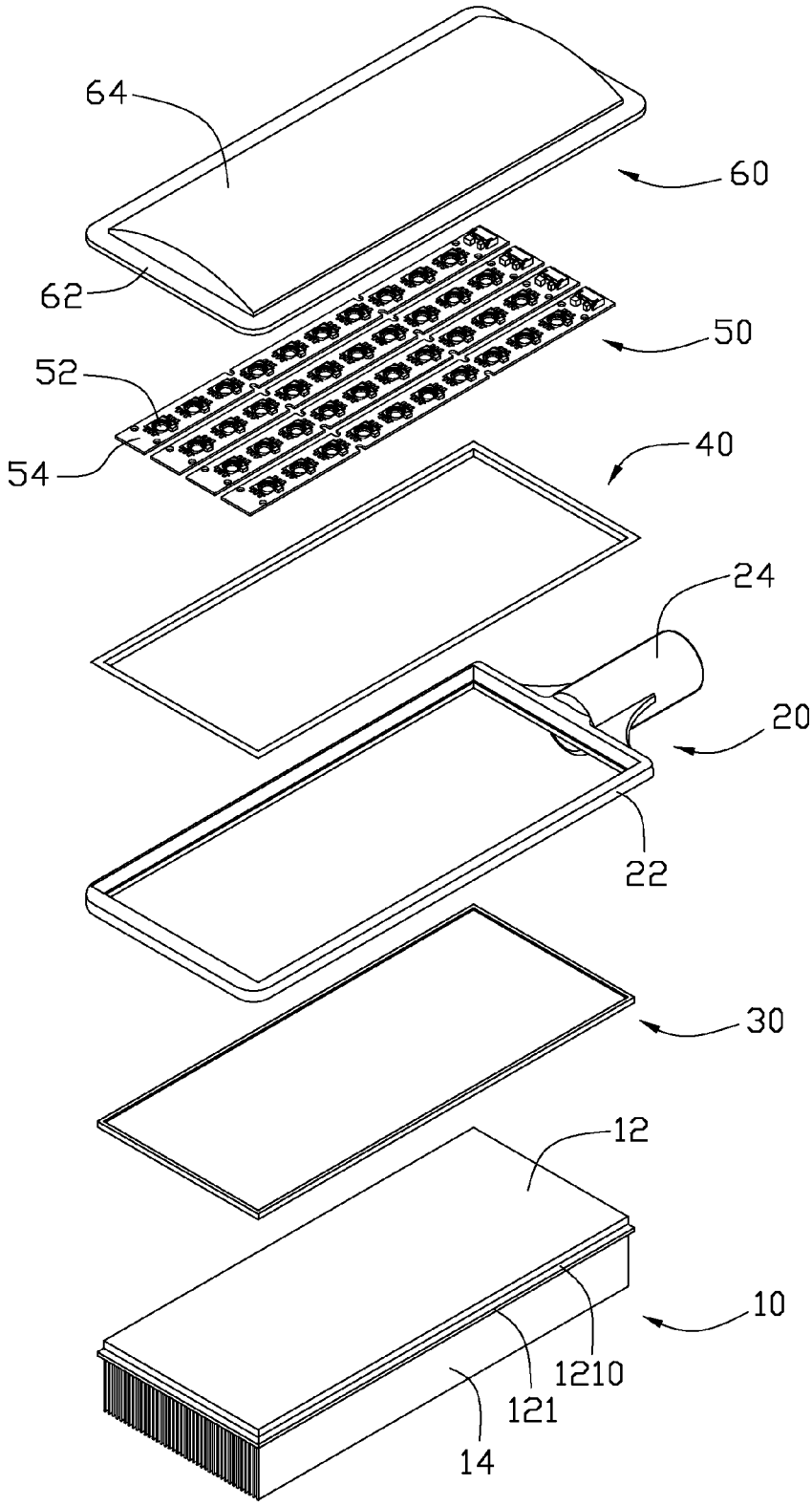
FIG. 2 is an exploded view of FIG. 1.

Referring to FIGS. 1 and 2, an LED lamp is shown. The LED lamp comprises a heat sink 10, a plurality of LED modules 50 thermally attached to the heat sink 10, a housing 20 surrounding a circumference of the heat sink 10 and a hood 60 covering on the LED modules 50. A first waterproof gasket 30 is wedged between the heat sink 10 and the housing 20. A second waterproof gasket 40 is wedged among the housing 20, the hood 60 and the heat sink 10.

The heat sink 10 is made from a metal block with a good heat conductivity. The heat sink 10 comprises a substantially rectangular base 12 and a plurality of fins 14 integrally extending from the base 12. The base 12 has a first portion (not labeled) adjacent to the fins 14 and a second portion (not labeled) remote from the fins 14. The first portion extends outwardly beyond the second portion to form a flange 121 at a circumferential periphery of the base 12. The second portion of the base 12 has an upright lateral periphery face (not labeled) and a top flat face (not labeled) perpendicular to the lateral periphery face thereof. The flange 121 has an upright lateral periphery face (not labeled) located outside and parallel to the lateral periphery face of the second portion. The first portion has a slant face 1210 connecting a bottom of the lateral periphery face of the second portion and a top of the lateral periphery face of the flange 121. A recessed corner (not labeled) is defined between the flange 121 of the first portion and the second portion of the base 12. The fins 14 are parallel to each other and extend outwardly from a bottom face of the first portion of the base 12. Outmost ones of the fins 14 each have an outer side face coplanar with a corresponding part of the lateral periphery face of the second portion of the base 12. All of the fins 14 define an area (not labeled) in the bottom face of the first portion of the base 12. The flange 121 extends outwardly from a periphery of the area defined by the fins 14.

Each LED module 50 comprises a rectangular substrate plate 54 and a plurality of LEDs 52 linearly mounted on the plate 54. The plurality of LED modules 50 are attached onto the top face of the second portion of the base 12 side by side.

Figure 3:
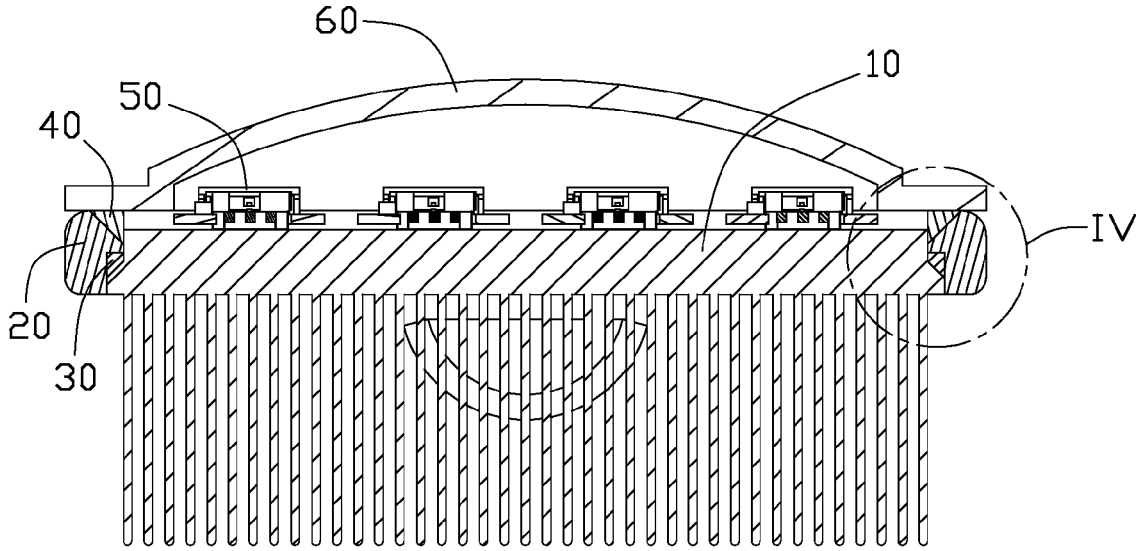
FIG. 3 is a cross-sectional view of FIG. 1, taken along a line III-III thereof.
Figure 4:
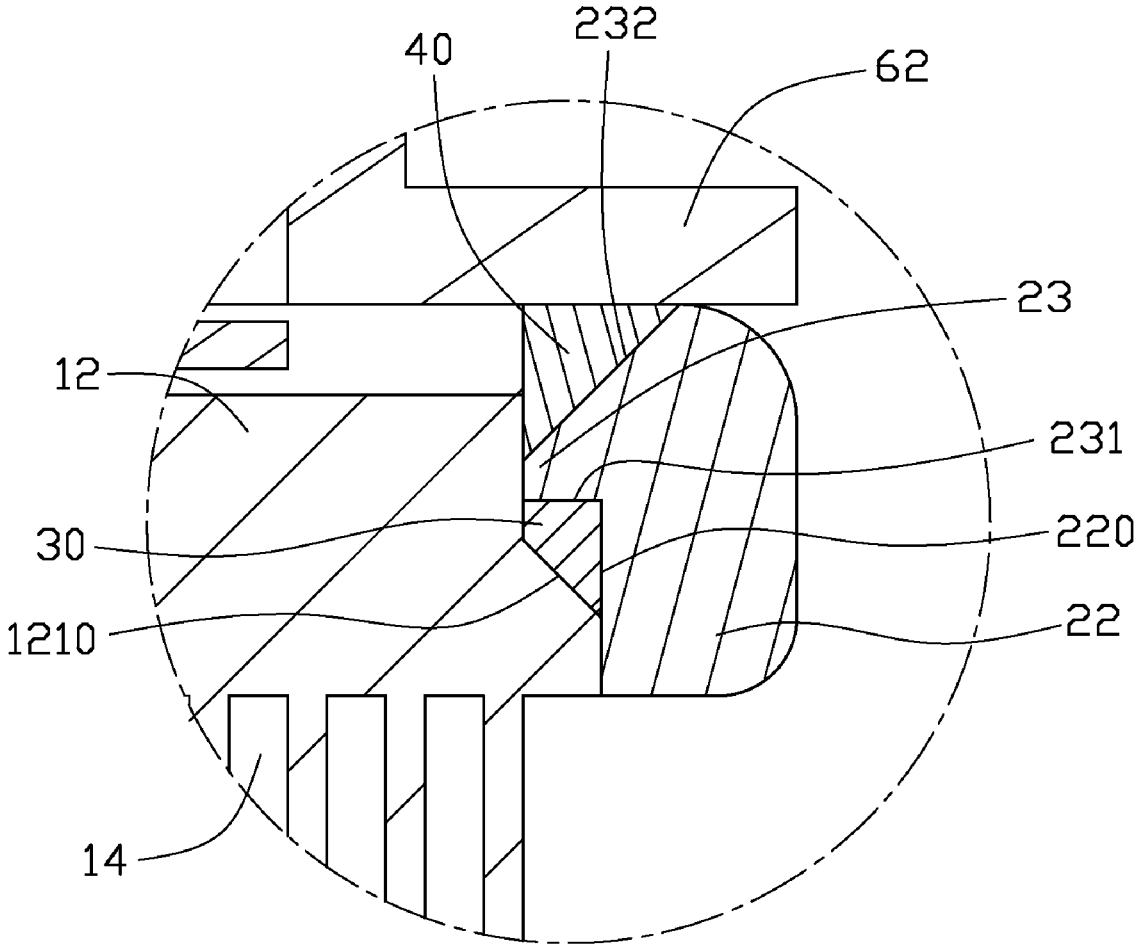
FIG. 4 is an enlarged view of a part IV of FIG. 3.

Referring also to FIGS. 3 and 4, the housing 20 is made from a one-piece member which preferably is plastic, and comprises a rectangular frame 22 and a connecting collar 24 integrally extending from an end of the frame 22. The connecting collar 24 is used for connecting with a supporting rod (not shown) which can support the LED lamp at a desired position. The frame 22 surrounds the plates 54 of the LED modules 50 and the base 12 of the heat sink 10. The frame 22 engages with the circumferential periphery of the base 12 of the heat sink 10. The frame 22 has a first portion (not labeled) at a lower end thereof and a second portion (not labeled) at an upper end thereof. The first portion of the frame 22 has an inner face 220 parallel to and engaging with the lateral periphery face of the flange 121 of the base 12 when the housing 20 is assembled to the base 12 of the heat sink 10. The second portion of the frame 22 extends inwardly a wedged protrusion 23 toward the base 12. The wedged protrusion 23 of the second portion engages with the lateral periphery face of the second portion of the base 12 at a location just above the recessed corner. The protrusion 23 has a first face 232, a second face 231 and a connecting face (not labeled) connecting with the first face 232 and the second face 231. It is the connecting face of the wedged protrusion 23 of the second portion of the frame 22 which engages with the lateral periphery face of the second portion of the base 12 at the location just above the recessed corner. The first face 232 slants upwards and outwardly from a top of the connecting face. The second face 231 is perpendicular to the lateral periphery face of the second portion of the base 12 and connects the connecting face with the inner face 220 of the first portion of the frame 22. The second face 231 of the protrusion 23, the inner face 220 of the first portion of the frame 22, the slant face 1210 of the first portion of the base 12 and the lateral periphery face of the second portion of the base 12 cooperatively define a first cavity surrounding the base 12 for receiving the first waterproof gasket 30 therein. The first cavity has a wedged cross section; in this embodiment, the first cavity has a cross section of a right-angled trapezia.

The hood 60 is a transparent member seated on the frame 22 of the housing 20 and covering the plates 54. The hood 60 comprises a rectangularly annular body 62 and an arched lid 64 extending upwardly from an inner periphery of the body 62. The body 62 has a flat bottom face (not labeled) contacting the top of the frame 22. The first face 232 of the protrusion 23 of the frame 22, the lateral periphery face of the second portion of the base 12, and the bottom face of the body 62 cooperatively define a second cavity (not labeled) above the first cavity and surrounding the circumferential periphery of the base 12. The second cavity has a triangular cross section. The lid 64 hoods the LEDs 52 therein.

The first waterproof gasket 30 is received in the first cavity between the frame 23 and the base 12. The first waterproof gasket 30 has a wedged cross section identical to that of the first cavity, and is a substantially rectangular ring. The first waterproof gasket 30 has a size slightly larger than that of the first cavity, whereby the first waterproof gasket 30 is compressed by the faces of the frame 23 and the base 12 which define the first cavity.

The second waterproof gasket 40 is received in the second cavity among the frame 23, the base 12 and the body 62 of the hood 60. The second waterproof gasket 40 has a triangular cross section identical to that of the second cavity, and is a substantially rectangular ring. The second waterproof gasket 40 has a size slightly larger than that of the second cavity, whereby the second waterproof gasket 40 is compressed by the faces of the frame 23, the base 12 and the body 62 which define the second cavity.

According to the preferred embodiment of the present invention, the base 12 of the heat sink 10 and the frame 23 of the housing 20 are configured to define the first cavity to receive the first waterproof gasket 30. The base 12 of the heat sink 10, the frame 23 of the housing 20 and the body 62 of the hold 60 are configured to defined the second cavity to receive the second waterproof gasket 40 therein. Thus, the disadvantages of the prior art that the housing needs to be provided with the special grooves to receive the gaskets therein can be avoided by the present invention, whereby the present invention can simplify the configuration and manufacture of the LED lamp. Additionally, since the first waterproof gasket 30 is wedged, it can be firmly and intimately compressed among the housing 20, the heat sink 10 and the hood 60; therefore, the waterproofing effectiveness of the LED lamp of the present invention is better than the prior art.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a base and a plurality of fins extending from the base;

a plurality of LED modules each comprising a substrate plate thermally attached to the base of the heat sink and a plurality of LEDs mounted on the substrate plate;

a housing comprising a frame surrounding the base of the heat sink, and cooperating with the heat sink to define a first cavity between the frame and the base of the heat sink;

a first waterproof gasket being received in the first cavity and surrounding the base of the heat sink; and a hood covering over the LEDs of the LED modules and contacting the frame of the housing;

wherein the base of the heat sink has a first portion adjacent to the fins and a second portion remote from the fins and having the LED modules attached thereon, the first portion and the second portion cooperatively define a recessed corner therebetween, the first waterproof gasket being located at the corner; and wherein the frame of the housing comprises a first portion contacting the first portion of the base, and a second portion contacting the hood, the second portion of the frame comprising a protrusion extending to the base and contacting the base at a side of the corner.

2. The LED lamp of claim 1, wherein the first waterproof gasket has a wedged cross section.

3. The LED lamp of claim 1, wherein the first cavity is surrounded by the first portion of the base, the second portion of the base, the protrusion of the frame and the first portion of the frame.

4. The LED lamp of claim 3, wherein the second portion of the base comprises a flat face having the LED modules mounted thereon, and a lateral periphery face perpendicular to the flat face.

5. The LED lamp of claim 4, wherein the first portion of the base comprises a lateral periphery face outside the lateral periphery face of second portion of the base, and a slant face connecting the lateral periphery faces of the first portion and the second portion of the base.

6. The LED lamp of claim 5, wherein the first portion of the frame of the housing comprises an inner face parallel to the lateral periphery face of the second portion of the base.

7. The LED lamp of claim 6, wherein the protrusion of the second portion of the frame comprises a second face perpendicular to the inner face of the first portion of the frame.

8. The LED lamp of claim 7, wherein the lateral periphery face of the second portion of the base, the slant face of the first portion of the base, the inner face of the first portion of the frame and the second face of the protrusion of the frame are interconnected, thereby defining the first cavity therebetween.

9. The LED lamp of claim 1, wherein the second portion of the base, the hood and the second portion of the frame cooperatively define a second cavity therebetween, a second waterproof gasket being received in the second cavity.

10. The LED lamp of claim 9, wherein the second cavity has a triangle cross section, the second waterproof gasket has a cross sectional identical to that of the second cavity.

11. The LED lamp of claim 9, wherein the hood comprises an annular body contacting the second portion of the frame of housing and the second waterproof gasket.

12. The LED lamp of claim 11, wherein the protrusion of the frame of the housing comprises a first face slanting from the body of the hood to the second portion of the base and contacting the second waterproof gasket.

13. An LED lamp comprising:

a heat sink comprising a base having a bottom surface and a top surface and a plurality of fins extending from the bottom surface;

a plurality of LED modules mounted on the top surface of the base of the heat sink;

a housing surrounding a periphery of the base of the heat sink;

a hood over the top surface of the base of the heat sink;

a first waterproof gasket sandwiched between a lower portion of the periphery of the base of the heat sink and a lower portion of the housing to form a hermetical connection therebetween;

a second waterproof gasket sandwiched among an upper portion of the periphery of the base of the heat sink, an upper portion of the housing and a bottom face of the hood to form a hermetical connection thereamong, whereby the LED modules can be hermetically received in the LED lamp.

14. The LED lamp of claim 13, wherein the first waterproof gasket has a cross section of a trapezia.

15. The LED lamp of claim 14, wherein the trapezia is a right-angled trapezia.

16. The LED lamp of claim 13, wherein the second waterproof gasket has a cross section of a triangle.

17. The LED lamp of claim 13, wherein the housing engages with the periphery of the base of the heat sink.

18. The LED lamp of claim 13, wherein the upper portion of the housing is a slantwise surface extending upwardly and outwardly.

* * * * *